US006598362B2

(12) United States Patent
Hikai

(10) Patent No.: US 6,598,362 B2
(45) **Date of Patent: *Jul. 29, 2003**

(54) FASTENING MEMBER AND SLIDING BOARDS ATTACHMENT STRUCTURE

(75) Inventor: Satoshi Hikai, Nagoya (JP)

(73) Assignee: Nichiha Co., Ltd., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/978,568

(22) Filed: Oct. 18, 2001

(65) Prior Publication Data

US 2002/0050111 A1 May 2, 2002

(30) Foreign Application Priority Data

Oct. 19, 2000 (JP) ..... 2000-319735

(51) Int. Cl.[7] ..... E04H 5/00; E04D 1/34
(52) U.S. Cl. ..... 52/235; 52/547
(58) Field of Search ..... 52/546, 547, 235, 52/489.1, 489.2, 772, 774, 781.3, 712, 698, 715

(56) References Cited

U.S. PATENT DOCUMENTS

| | | | | | |
|---|---|---|---|---|---|
| 4,288,958 | A | * | 9/1981 | Chalmers et al. | 52/478 |
| 4,409,766 | A | * | 10/1983 | Blackmore | 52/169.11 |
| 5,740,644 | A | * | 4/1998 | Menchetti | 52/281 |
| 6,055,787 | A | * | 5/2000 | Gerhaher et al. | 52/506.06 |
| 6,279,286 | B1 | * | 8/2001 | Ichihashi | 248/218.4 |
| 6,289,646 | B1 | * | 9/2001 | Watanabe | 52/235 |
| 6,315,489 | B1 | * | 11/2001 | Watanabe | 248/220.21 |
| 6,402,419 | B1 | * | 6/2002 | Watanabe | 403/381 |
| 6,460,311 | B1 | * | 10/2002 | Ito | 52/731.9 |
| 2002/0043029 | A1 | * | 4/2002 | Hikai | 52/58 |
| 2002/0095889 | A1 | * | 7/2002 | Hikai | 52/235 |

FOREIGN PATENT DOCUMENTS

| | | |
|---|---|---|
| JP | 6-158814 | 6/1994 |
| JP | 9-302889 | 11/1997 |
| JP | 2001-27031 | 1/2001 |
| JP | 2001-123639 | 5/2001 |

OTHER PUBLICATIONS

U.S. patent application Ser. No. 09/924,486, filed Aug. 9, 2001, pending.
U.S. patent application Ser. No. 09/970,671, filed Oct. 5, 2001, pending.
U.S. patent application Ser. No. 09/978,568, filed Oct. 18, 2001, pending.

* cited by examiner

*Primary Examiner*—Carl D. Friedman
*Assistant Examiner*—Kevin McDermott
(74) *Attorney, Agent, or Firm*—Oblon, Spivak, McClelland, Maier & Neustadt, P.C.

(57) ABSTRACT

The present invention provides a siding boards attachment structure having excellent ventilation characteristics and a high siding-board fixing strength, and a fastening member to be used therewith. The fastening member is disposed to span an upper horizontal edge of a lower siding board and a lower horizontal edge of an upper siding board, and fixes the siding boards to a framework of a building. The fastening member includes a base plate portion having a flat rear side surface, a support portion projecting forward from the base plate portion, an upper-board engagement portion bent upward from the support portion, a lower-board engagement portion bent downward from the support portion, and spacing portions individually formed at left and right sides of the base plate portion, each of the spacing portions having a front face which is forward from the base plate portion and rearward from the front end of the support portion.

22 Claims, 16 Drawing Sheets

FASTENING MEMBER AND SLIDING BOARDS ATTACHMENT STRUCTURE

CROSS-REFERENCES TO RELATED APPLICATIONS

The present application claims priority under 35 U.S.C. § 119 to Japanese Patent Application No.2000-319735, filed Oct. 19, 2000, entitled "FASTENING MEMBER AND SIDING BOARDS ATTACHMENT STRUCTURE". The contents of this application are incorporated herein by reference in their entirety.

BACKGROUND OF THE INVENTION

1. Field of the Invention

The present invention relates to a fastening member for fixing a siding board to a framework of a building, and further relates to a siding boards attachment structure using the fastening member.

2. Discussion of the Background

Conventionally, there are used siding boards attachment structures of a type as shown in FIG. 14 by way of example. The figure shows a siding boards attachment structure 8 formed such that a fastening member 9 is disposed to engage an upper horizontal edge 21 of a lower siding board 2 and a lower horizontal edge 22 of an upper siding board 2, and the siding boards 2 and 2 are fixed to a framework 3 of a building via a furring strip 89 or the like.

As shown in FIGS. 14 and 15, the fastening member 9 has a base plate portion 91, a support portion 92, an upper-board engagement portion 93, and a lower-board engagement portion 94. The base plate portion 91 abuts on rear side surfaces 26 of the siding boards 2 disposed vertically. The support portion 92 is formed forward from the base plate portion 91. The upper-board engagement portion 93 is formed to bend in a slant and upper direction from the support portion 92. The lower-board engagement portion 94 is formed to bend in a slant and lower direction from the support portion 92. In front of the upper-board engagement portion 93 and the lower-board engagement portion 94, a front flat plate 934 is formed.

In addition, as shown in FIG. 15, the base plate portion 91 has a sloped portion 911 and a lower leg portion 912. The sloped portion 911 is formed to be rearwardly slant at an upper portion of its own. The lower leg portion 912 is rearwardly bent at substantially 90 degrees at a lower end portion of its own.

In the siding boards attachment structure 8, as an underlayment (for example, a sheathing board), a heat insulator 83 is fixed to the outside of the framework 3 such as a column as shown in FIG. 14. From the outside of the heat insulator 83, the furring strip 89 is fixed to the framework 3 via a waterproof paper 82. In addition, in the outside of the furring strip 89, the fastening member 9 is disposed and is fixed to the framework 3 with a screw 4.

The fastening member 9 fixes the siding boards 2 in a manner in which the upper horizontal edge 21 of the lower siding board 2 is engaged with the lower-board engagement portion 94, the upper siding board 2 is supported by the support portion 92, and the lower horizontal edge 22 is engaged with the upper-board engagement portion 93.

In the siding boards attachment structure 8, since the furring strip 89 is disposed in the above-described manner, a ventilation space 81 having a sufficient thickness can be secured between the heat insulator 83 and the siding boards 2. Thereby, ventilation characteristics are secured; and the components, such as the siding boards 2, and the framework 3, are prevented from being corroded and deteriorated because of water absorption. Thereby, the durability of the siding boards attachment structure 8 is improved.

However, the siding boards attachment structure 8 is still problematic in that the furring strip 89 needs to be installed, thereby increasing the processing time as well as material costs.

Specifically, when the siding boards attachment structure 8 is constructed, the furring strip 89 having regulated dimensions needs to be prepared, and in addition, a step is required for nailing the furring strip 89 to the framework 3.

If the furring strip 89 is not used, by way of example, the siding boards attachment structure 80 will be obtained by disposing a heat insulator 84 in the outside of a framework 3 and fixing a fastening member 9 to a framework 3 from the outer side via a waterproof paper 82 and the heat insulator 84, as shown in FIG. 16A.

For the heat insulator 84, a material, such as a stylofoam, a sheathing board, or an oriented strand board (OSB), is used.

As mentioned above, in the siding boards attachment structure 80, since no furring strip is used, taking bend of the waterproof paper 82 into account, it can not be said that a ventilation space 81 is sufficiently secured.

In the siding boards attachment structure 80, when a soft heat insulator 84 is used, the fastening member 9 is fixed on the surface thereof. Therefore, as shown in FIG. 16B, a case can occur in which the fastening member 9 is forced to be sunk into the heat insulator 84, thereby disabling the fastening member 9 from being fixed in a stable state. Particularly, since the contact area of the lower leg portion 912 of the fastening member 9 and the heat insulator 84 is small, a defective case is likely to occur in which the lower leg portion 912 sinks in the heat insulator 84, and consequently, the fastening member 9 leans forward and rearward.

As a result, as shown in FIG. 16B, the siding boards 2 fixed with the fastening member 9 is placed in an unstable condition. Therefore, substantially, it is difficult to achieve the fixing of the fastening member 9 to the framework 3.

SUMMARY OF THE INVENTION

An object of the present invention is to provide a siding boards attachment structure that is excellent in ventilation and that has a high structural strength for fixing siding boards, and a fastening member that is to be used with the aforementioned siding boards attachment structure.

According to a first aspect of the present invention, a fastening member disposed to span an upper horizontal edge of a lower siding board and a lower horizontal edge of an upper siding board for fixing the siding boards to a framework of a building, includes a base plate portion having a flat rear side surface, a support portion projecting forward from the base plate portion, an upper-board engagement portion bent upward from the support portion, a lower-board engagement portion bent downward from the support portion, and spacing portions individually formed at left and right sides of the base plate portion, each of the spacing portions has a front face which is forward from the base plate portion and rearward from the front end of the support portion.

The notable feature in the first aspect of the invention is that the fastening member has the base plate portion having the flat rear side surface, and the spacing portions formed at left and right sides of the base plate portion.

Hereinafter, operational advantages of the present invention will be described.

The siding boards can be fixed to the framework by using the fastening member in the manners described below.

The base plate portion of the fastening member is fixed to the framework such that the rear side surface of the base plate portion is directly set to abut on the framework or that the rear side surface of the base plate portion is fixed to the framework via a heat insulator. At this time, the lower-board engagement portion of the fastening member is set to engage with the upper horizontal edge of the lower siding board.

Subsequently, a construction is performed such that the lower horizontal edge of the upper siding board is set to be supported by the support portion of the fastening member and is engaged with upper board engagement portion. At this time, the rear side surfaces of the siding boards are set to abut on the spacing portions of the fastening member.

As described above, the fastening member has the spacing portions. The construction is therefore performed by setting the rear side surfaces of the siding boards to abut on the spacing portions. This manner enables a ventilation space to be formed behind the siding boards. That is, a sufficient gap is provided between the siding boards and the framework, thereby enabling ventilation characteristics to be secured.

The above construction therefore prevents the siding board and the framework from being corroded and deteriorated.

Furthermore, the fastening member has the spacing portions individually at the left and right sides. The rear side surfaces of the siding boards abut on the spacing portion, whereby the fastening fitting can support the siding boards in a stable state. Consequently, the siding boards attachment structure can be constructed to have high resistances for wind pressure and the like, and a high structural strength.

Still furthermore, since the fastening member includes the base plate portion having the flat rear side surface, the entirety of the rear side surface of the base plate portion in the fastening member can be set to abut on the framework or heat insulator. In this case, a contact area of the fastening member and an underlayment on which the fastening member abuts is large. Particularly, when the fastening member is set to abut on a soft underlayment such as a heat insulator and the like in order to be fixed to the framework, the fastening member is prevented from being sunk into the soft underlayment. Therefore, the siding board can be attached to be stable.

Thus, the siding boards attachment structure having excellent resistances for wind pressure and a high structural strength can be constructed.

As described above, the present invention can provide the fastening member that enables the attachment of the siding boards attachment structure having excellent ventilation characteristics and a high structural strength for fixing the siding boards.

According to a second aspect of the invention, a starter fastening member for supporting a lower horizontal edge of a lowest siding board to fix the siding board to a framework of a building, includes a base plate portion having a flat rear side surface, a support portion projecting forward from the base plate portion, an upper-board engagement portion bent upward from the support portion, and spacing portions individually formed at left and right sides of the base plate portion, each of the spacing portions has a front face which is forward from the base plate portion and rearward from the front end of the support portion.

Also in this case, the fastening member that enables the construction of the siding boards attachment structure having excellent ventilation characteristics and a high structural strength for fixing the siding boards can be provided.

According to a third aspect of the present invention, a siding boards attachment structure is constructed such that the above-described fastening member is disposed on an upper horizontal edge and a lower horizontal edge of siding boards, and the siding boards are fixed to a framework of a building, wherein the fastening member is fixed to the framework such that the base plate portion is set to abut on the framework and the spacing portions are set to abut on rear side surfaces of the siding boards, and a ventilation space is formed between the framework and the siding boards.

The notable feature in the siding boards attachment structure is that the fastening member is fixed to the framework such that the base plate portion is set to abut on the framework, and the spacing portions are set to abut on the rear side surfaces of the siding boards.

In the siding boards attachment structure, since the base plate portion having the flat rear side surface is set to abut on the framework, the fastening member can be fixed to be stable. In addition, since the rear side surfaces of the siding boards are set to abut on the spacing portions formed at the left and right sides of the base plate portion, the siding boards can be fixed to be stable.

Consequently, the siding boards attachment structure having high resistances for wind pressure and the like and a high structural strength can be obtained.

Furthermore, since the rear side surfaces of the siding boards are set to abut on the spacing portions, the ventilation space having a sufficient thickness can be formed behind the siding boards. Consequently, the siding boards attachment structure having excellent ventilation characteristics can be provided.

As described above, according to the third aspect of the present invention, the siding boards attachment structure having excellent ventilation characteristics and a high structural strength for fixing the siding boards can be obtained.

According to a fourth aspect of the present invention, a siding boards attachment structure is constructed such that the above-described starter fastening member is disposed on a lower horizontal edge of a lowest siding board, and the siding board is fixed to a framework of a building, wherein the starter fastening member is fixed to the framework such that the base plate portion is set to abut on the framework and the spacing portions are set to abut on a rear side surface of the siding board, and a ventilation space is formed between the framework and the siding boards.

Also in this case, the siding boards attachment structure having excellent ventilation characteristics and a high structural strength for fixing the siding boards can be provided.

According to a fifth aspect of the present invention, a siding boards attachment structure is constructed such that the above-described fastening member is disposed on an upper horizontal edge and a lower horizontal edge of siding boards, and the siding boards are fixed to a framework of a building, wherein a heat insulator is fixed to the outside of the framework, the fastening member is fixed to the framework such that the base plate portion is set to abut on the heat insulator and the spacing portions are set to abut on rear side surfaces of the siding boards, and a ventilation space is formed between the heat insulator and the siding boards.

In the siding boards attachment structure, since the heat insulator can be fixed from the outside of the framework, the siding boards attachment structure having heat-resisting effects can be constructed easily.

Furthermore, in the siding boards attachment structure, the base plate portion of the fastening member is fixed to a surface of the soft heat insulator. However, since the rear side surface of the base plate portion is flat, and a contact area of the heat insulator and the rear side surface is large, the base plate portion is not sunk into the heat insulator. Consequently, the fastening member can be fixed via the heat insulator to the framework to be stable.

Still furthermore, since the rear side surfaces of the siding boards are set to abut on the spacing portions at the left and right sides of the base plate portion, the siding boards can be fixed to be stable.

Consequently, the siding boards attachment structure having high resistances for wind pressure and the like and a high structural strength can be obtained.

Still furthermore, since the rear side surfaces of the siding boards are set to abut on the spacing portions, the ventilation space having a sufficient thickness can be formed behind the siding boards. Consequently, the siding boards attachment structure having excellent ventilation characteristics can be obtained.

As described above, according to the fifth aspect of the present invention, the siding boards attachment structure having excellent ventilation characteristics and a high structural strength for fixing the siding boards can be provided.

According to a sixth aspect of the present invention, a siding boards attachment structure is constructed such that the above-described starter fastening member is disposed on a lower horizontal edge of a lowest siding board and the siding board is fixed to a framework of a building, wherein a heat insulator is fixed to the outside of the framework, the starter fastening member is fixed to the framework such that the base plate portion is set to abut on the heat insulator and the spacing portions are set to abut on a rear side surface of the siding board, and a ventilation space is formed between the heat insulator and the siding board.

Also in this case, the siding boards attachment structure having excellent ventilation characteristics and a high structural strength for fixing the siding boards can be provided.

BRIEF DESCRIPTION OF THE DRAWINGS

A more complete appreciation of the invention and many of the attendant advantages thereof will become readily apparent with reference to the following detailed description, particularly when considered in conjunction with the companying drawings, in which.

DESCRIPTION OF THE PREFERRED EMBODIMENTS

In the above-described first and second aspects of the invention, it is preferable that each of the spacing portions has a front face forwardly formed 15 to 20 mm away from the rear side surface of the base plate portion.

Therefore, the siding board can be fixed to be sufficiently away from the framework or an underlayment, for example, the heat insulator. Consequently, a ventilation space having a sufficient thickness can be formed behind the siding boards.

When the distance between the front face of each of the spacing portions and the rear side surface of the base plate portion is less than 15 mm, ventilation space having sufficient thickness cannot not be formed. Therefore, there is apprehension that ventilation characteristics may not be sufficient. On the other hand, when the distance between the front face of each of the spacing portions and the rear side surface of the base plate portion is more than 20 mm, the load of the siding board is overexerted on front portions of the fastening member, thereby making it difficult for the fastening member to fix the siding board to be stable.

It is preferable that the fastening member includes a lower reinforcement portion between the support portion and a lower portion of the base plate portion, which is below the support portion, for reinforcing the support portion from a lower portion.

The lower reinforcement portion increases the structural strength of the support portion, thereby enabling a heavier siding board to be supported. With the spacing portions formed to protrude larger, the support portion needs to be formed longer than the length of the spacing portion. Also in this case, however, the support portion can withstand the load of the siding board sufficiently.

It is preferable that the fastening member has an upper reinforcement portion between the support portion and an upper portion of the base plate portion, which is above the support portion, for reinforcing the support portion from an upper portion.

Also in this case, the structural strength of the support portion for the load of the siding board is increased.

Figures 7A, 7B:
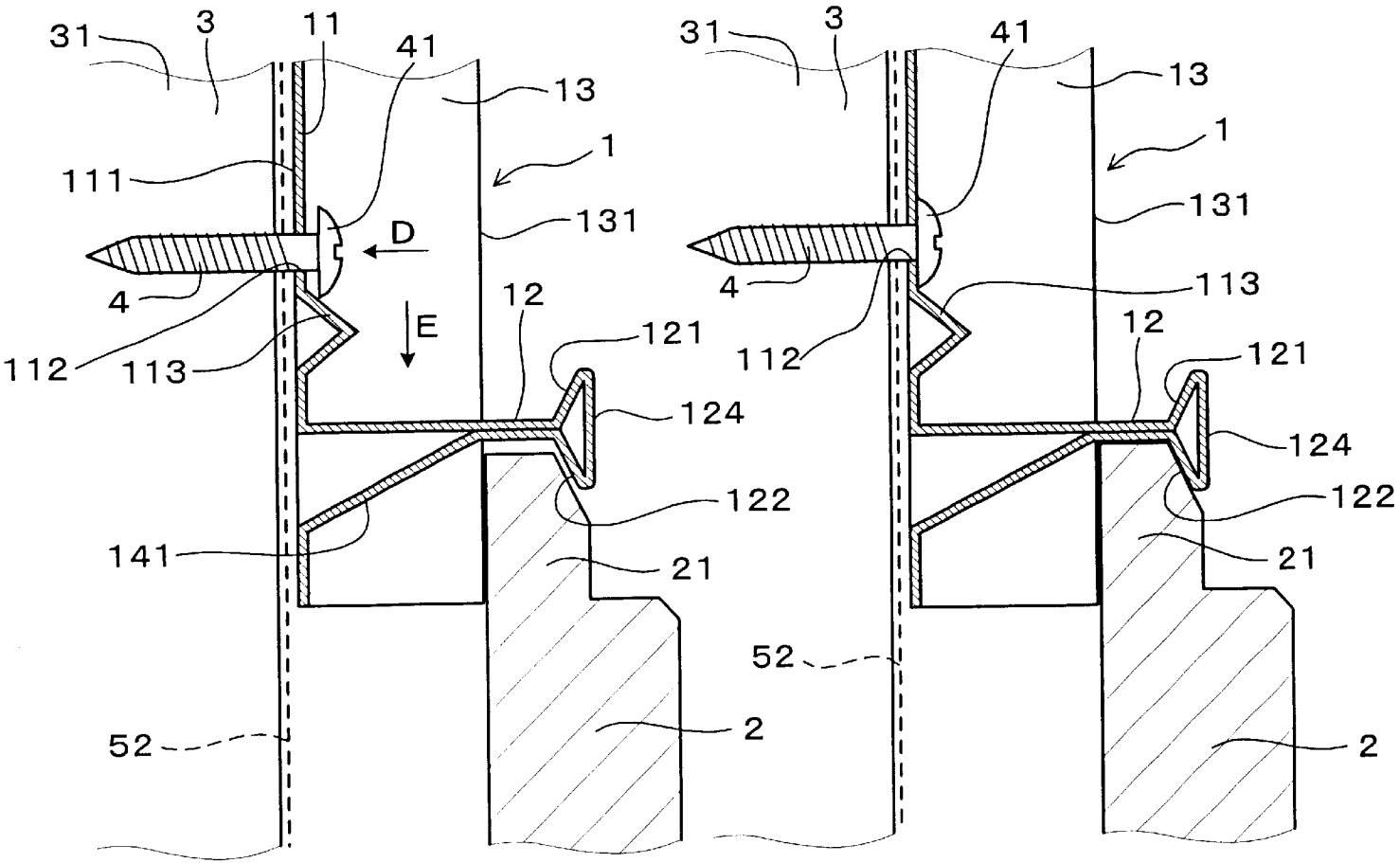
FIGS. 7A and 7B each show a functional explanatory view of a sloped portion provided in the fastening member according to the Embodiment 1.

In addition, it is preferable that the fastening member is structured such that the base plate portion has a screw hole through which a screw for fixing the fastening member to the framework is inserted; a sloped portion protruding forward and downward from the base plate portion is formed in a position below the screw hole; and when the screw inserted through the screw hole is screwed into the framework, a head portion of the screw engages with the sloped portion, thereby exerting a force downwardly thrusting the fastening member (as shown in FIGS. 7A and 7B).

According to the above structure, the fastening member enables the lower siding board to be fixed to the framework more securely.

In this case, it is preferable that the sloped portion is integrated with the upper reinforcement portion.

Thereby, the fastening member that can be easily manufactured can be obtained.

In addition, it is preferable that the fastening member is integrally formed by bending a metal plate.

Thereby, the fastening member that can be easily manufactured and that is cheap can be obtained.

For the heat insulator, for example, a stylofoam, a sheathing board, an oriented strand board (OSB), or styrene board may be used.

Alternatively, the siding boards attachment structure may be constructed by an external insulation method.

It is preferable that the ventilation space has a thickness ranged from 15 to 20 mm.

Thereby, the ventilation characteristics of the siding boards attachment structure can be improved. This improvement prevents siding boards, the siding boards attachment structure and the like, from being corroded and deteriorated.

When the thickness of the ventilation space is less than 15 mm, there is apprehension that sufficient ventilation characteristics cannot be obtained. On the other hand, when the thickness of the ventilation space is larger than 20 mm, there is apprehension that the portion on which the load of the siding board is supported is too forward of the fastening member, thereby making it difficult for the fastening member to fix the siding board to be stable.

Embodiment 1

Hereinafter, referring to FIGS. 1 to 7, a description will be made regarding a fastening member and a siding boards attachment structure according to Embodiment 1 of the present invention.

Figure 5:
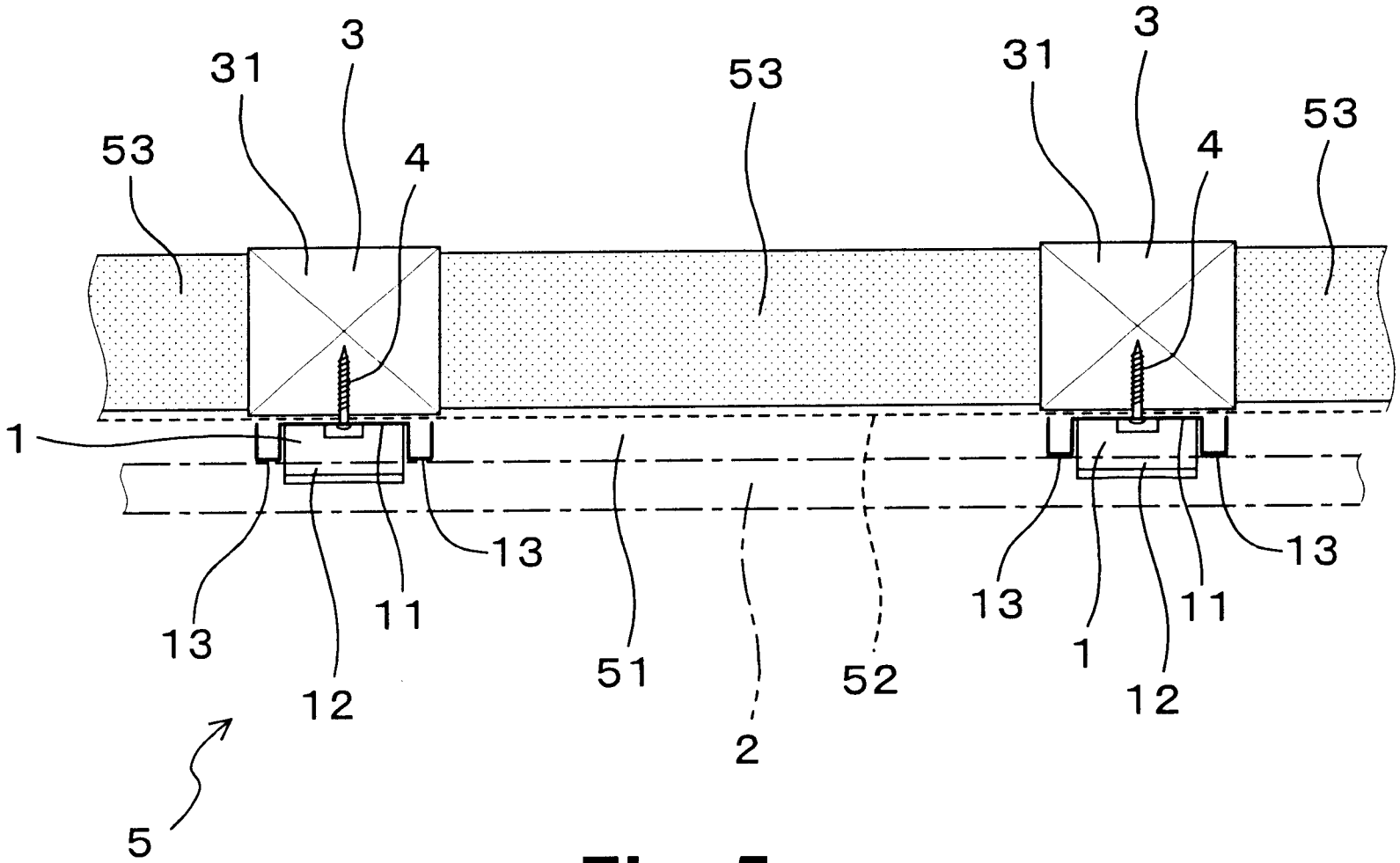
FIG. 5 is a horizontal cross sectional view of the siding boards attachment structure according to the Embodiment 1.
Figure 6:
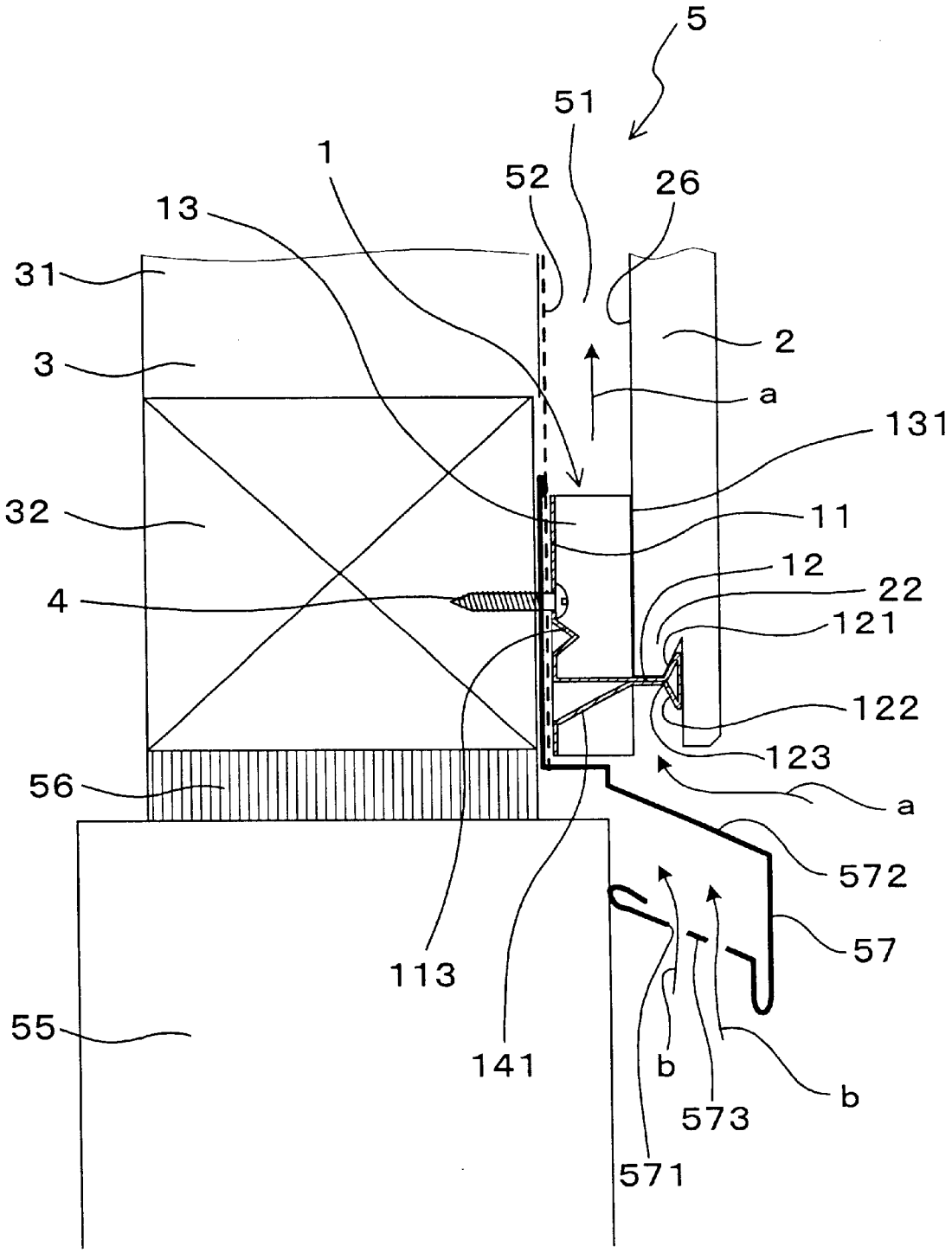
FIG. 6 is an explanatory view of a groundsill portion of the siding boards attachment structure according to the Embodiment 1.

FIGS. 1, 2A, 2B, and 2C are explanatory views of a fastening member 1 according to the present embodiment. FIGS. 3 to 6 are explanatory views of a siding boards attachment structure 5 according to the present embodiment. FIG. 4 is a vertical cross sectional view of the siding boards attachment structure 5. FIG. 5 is a horizontal cross sectional view of the siding boards attachment structure 5. FIG. 6 is a vertical cross sectional view of the siding boards attachment structure 5 in a groundsill portion. FIGS. 7A and 7B each show a functional explanatory view of a sloped portion 113 provided in the fastening member 1.

Figure 3:
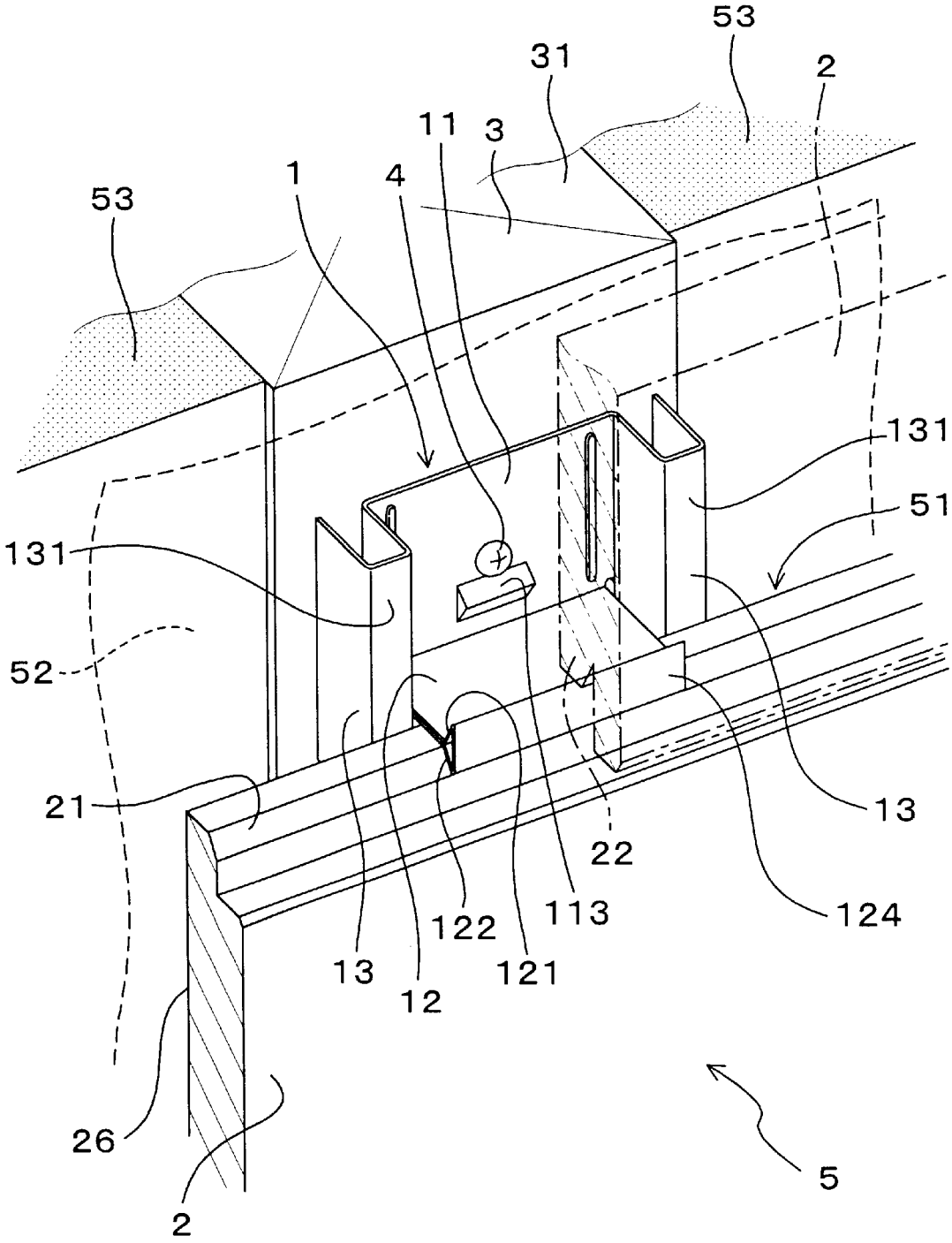
FIG. 3 is a perspective view of a siding boards attachment structure according to the Embodiment 1.
Figure 4:
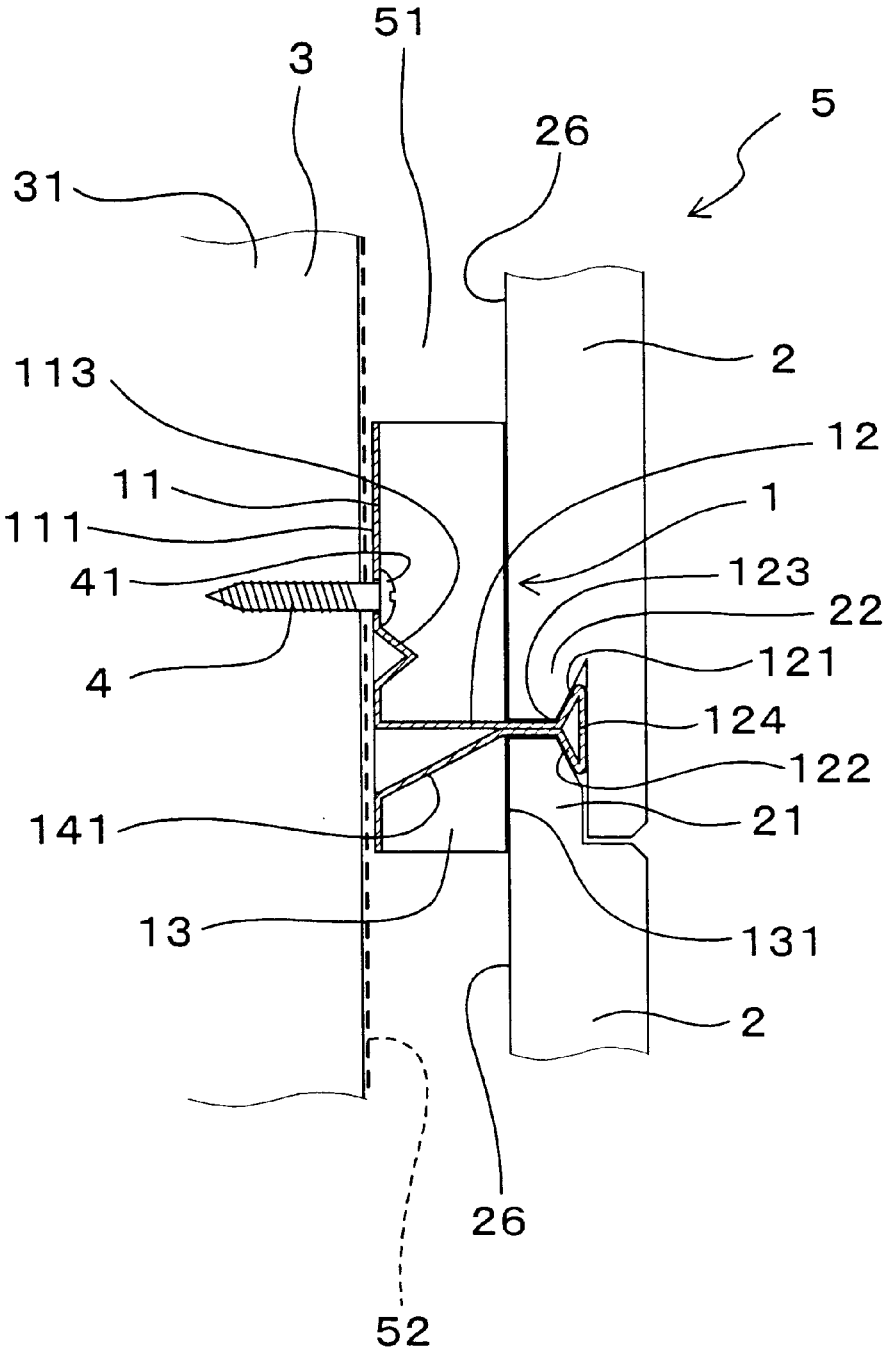
FIG. 4 is a vertical cross sectional view of the siding boards attachment structure according to the Embodiment 1.

As shown in FIGS. 3 and 4, the fastening member 1 is disposed in such a manner as to span an upper horizontal edge 21 of a lower siding board 2 and a lower horizontal edge 22 of an upper siding board 2 to fix the siding boards 2 to a framework 3.

As shown in FIGS. 1, 2A, 2B, and 2C, the fastening member 1 has a base plate portion 11 and a support portion 12. The base plate portion 11 is formed to include a rear side surface 111, and the support portion 12 formed to extend forward from the base plate portion 11. In addition, the fastening member 1 has an upper-board engagement portion 121, a lower-board engagement portion 122, and spacing portions 13. The upper-board engagement portion 121 is formed to bend upward from the support portion 12. The lower-board engagement portion 122 is formed to bend downward from the support portion 12. The spacing portions 13 are individually formed at left and right sides of the base plate portion 11. Each of the spacing portions 13 is formed to project forwardly such that a front face 131 of the spacing portion 13 is forward from the base plate portion 11 and rearward from a front end 123 of the support portion 12.

Figure 2A:
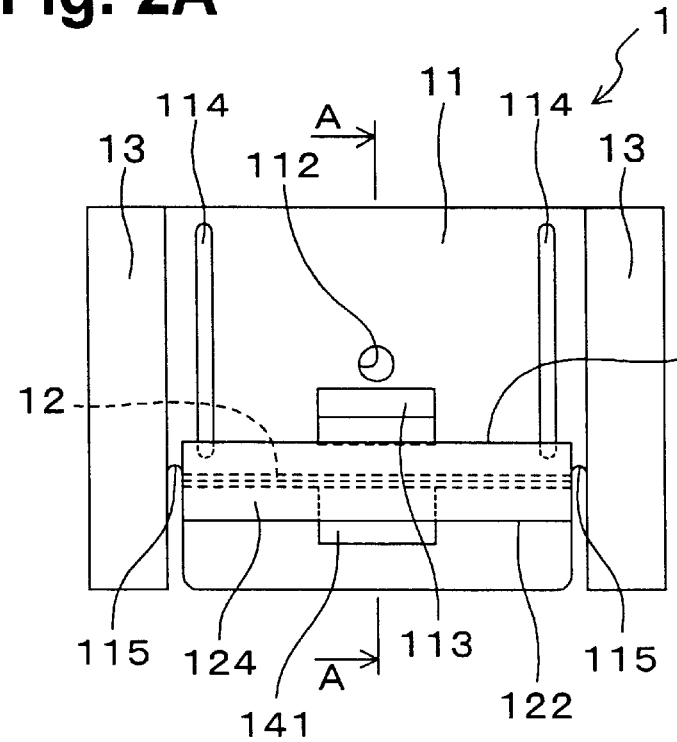
FIG. 2A is a front view of the fastening member according to the Embodiment 1.
Figure 2B:
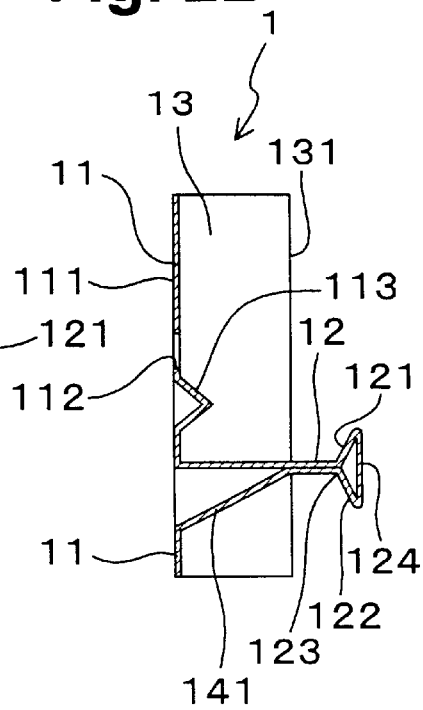
FIG. 2B is a cross sectional view taken along the line A—A of FIG. 2A.
Figure 2C:
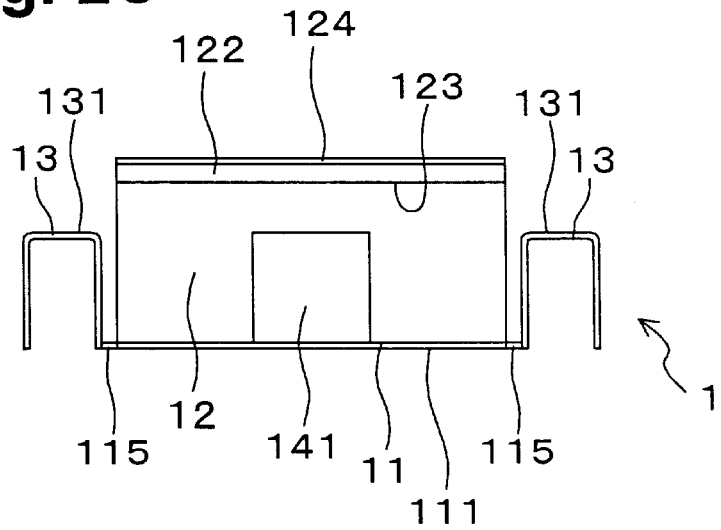
FIG. 2C is a bottom view thereof.

As shown in FIG. 2C, each of the spacing portions 13 is formed such that each of the two sides of the base plate portion 11 is bent forward, is bent outward, and is then bent rearward to have the cross sectional shape of a squarish letter U.

The ends of the upper-board engagement portion 121 and the lower-board engagement portion 122 are connected by a front flat plate 124.

The fastening member 1 is integrally formed through bending a stainless steel plate.

The support portion 12 is formed by bending the stainless steel plate to be overlapped with spot welding being performed at portions thereof. Thus, the support portion 12 is formed to have a sufficient structural strength.

As shown in FIGS. 2B and 2C, each of the spacing portions 13 is formed such that the front face 131 thereof is positioned 15 mm forwardly apart from the rear side surface 111 of the base plate portion 11.

To reinforce the support portion 12 from a lower portion thereof, a lower reinforcement portion 141 is formed between the support portion 12 and a part of the base plate portion 11 below the support portion 12.

Figure 1:
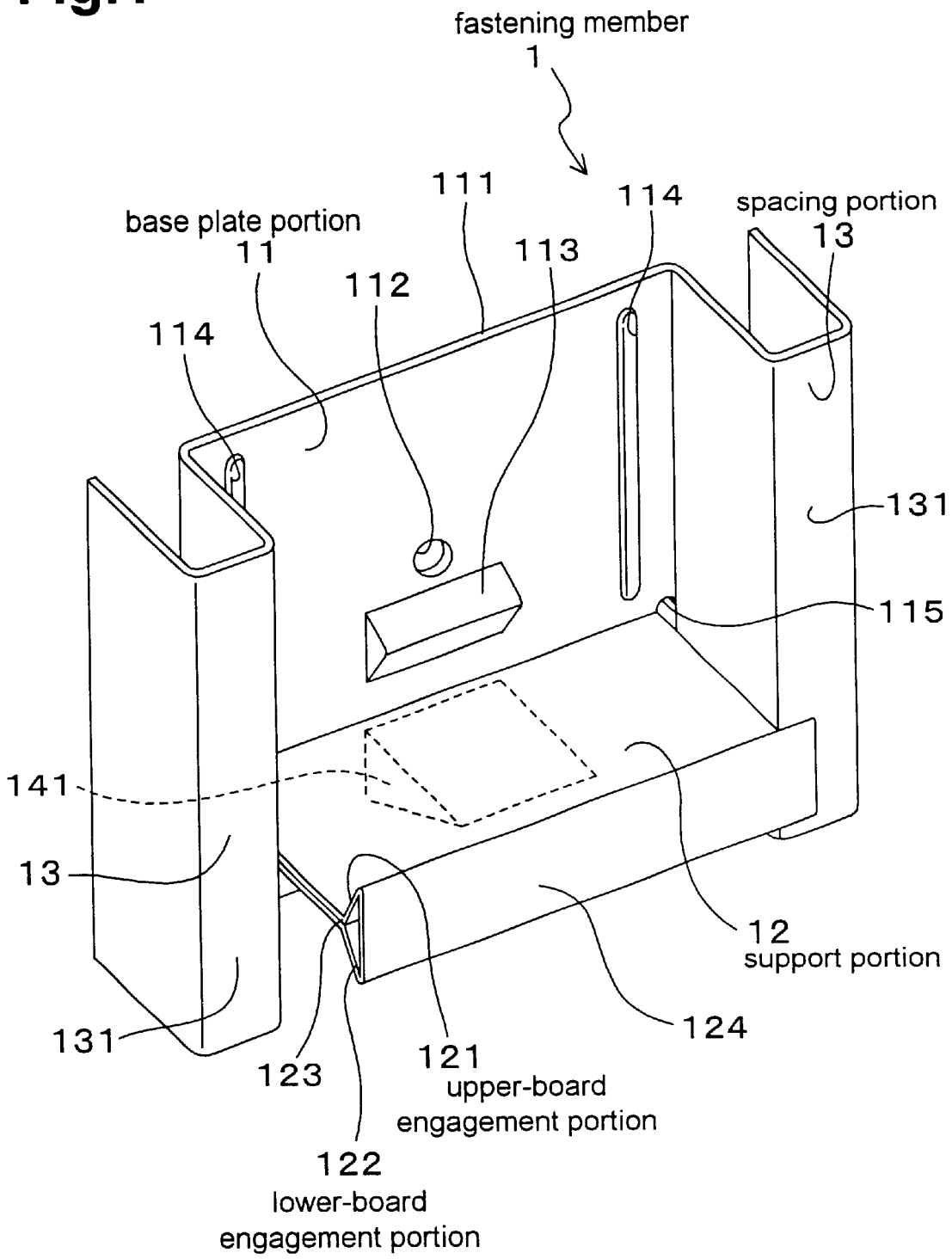
FIG. 1 is a perspective view of a fastening member according to Embodiment 1.

As shown in FIGS. 1, 2A, and 2B, the base plate portion 11 has a screw hole 112 through which the screw 4 is inserted to fix the fastening member 1 to the framework 3. Below the screw hole 112, there is provided the sloped portion 113 protruding forward and downward from the base plate portion 11.

As shown in FIGS. 7A and 7B, the fastening member 1 is formed such that, when the screw 4 inserted through the screw hole 112 is screwed into the framework 3, a head portion 41 of the screw 4 engages with the sloped portion 113, thereby exerting a force downwardly thrusting the fastening member 1.

As shown in FIGS. 1 and 2A, in the base plate portion 11, reinforcement ribs 114 projecting forward by about 1 mm are individually formed on left and right portions thereof in the vertical direction. In addition, as shown in FIG. 2A, cutouts 115 for bending are formed at both ends of a base end portion of the support portion 12 in the base plate portion 11.

As shown in FIG. 6, the fastening member 1 is concurrently used as a starter fastening member that supports the lower horizontal edge 22 of the lowest siding board 2 to thereby fix the siding boards 2 to the framework 3.

Hereinafter, referring to FIGS. 3 to 7B, a description will be made regarding the siding boards attachment structure 5 using the above-described fastening member 1 according to the present invention.

As shown in FIGS. 3 to 5, the fastening member 1 is disposed to engage the upper horizontal edge 21 of the lower-side siding board 2 and the lower horizontal edge 22 of the upper siding board 2 to thereby fix the siding boards 2 to the framework 3 of a building. In this way, the siding boards attachment structure 5 of the present embodiment is structured.

As shown in FIGS. 3 to 6, the base plate portion 11 is set to abut on the framework 3, and the spacing portions 13 are set to abut on the rear side surfaces 26 of the siding boards 2. In this way, the fastening member 1 is fixed to the framework 3.

A ventilation space 51 having a thickness of 15 mm is formed between the framework 3 and the siding boards 2.

A waterproof paper 52 is adhered on the outside of the framework 3. Via the waterproof paper 52, the fastening member 1 is fixed to the framework 3.

The fastening member 1 is fixed with the screw 4 to a vertical column 31 of the framework 3. In addition, a heat insulator 53 made of glass wool is inserted between the vertical column 31 and an adjacent vertical column 31.

FIG. 6 shows the fastening member 1 disposed in a groundsill portion of the siding boards attachment structure 5 in a manner similar to the above. In this case, the fastening member 1 supports a siding board 2 that is fixed at the lowest portion (which will hereinafter referred to as "lowest siding board"). Specifically, in the groundsill portion of the siding boards attachment structure 5, a horizontal column 32 is disposed on a ground sill 55 via a base packing 56. The starter fastening member 1 is fixed to the horizontal column 32 via the waterproof paper 52.

The lowest siding board 2 is supported by the support portion 12 of the fastening member 1.

As shown in FIG. 6, a groundsill flashing 57 is disposed in a lower portion of the lowest siding board 2. Outside air enters from a gap between the lower end portion of the siding board 2 and an upper sloped face 572 of the groundsill flashing 57. The air then ascends through the ventilation space 51 in the direction shown by an arrow a, thereby allowing ventilation characteristics to be secured. Ventilation holes 571 are formed on a lower slant face 573 of the groundsill flashing 57. Outside air flows in through the ventilation holes 571 (as shown by arrows b), flows through clearances formed with the base packing 56, and flows out to the inside of the framework 3.

To construct the siding boards attachment structure 5, first, the starter fastening member 1 is fixed with the screw 4 to the framework 3 in the position where the lower horizontal edge 22 of the lowest siding board 2 is to be disposed.

Subsequently, the lowest siding board 2 is set to be supported by the support portion 12 of the starter fastening member 1 and to engage with the upper-board engagement portion 121. At this time, the fastening member 1 is set so that the rear side surface 26 of the siding board 2 abuts on the front faces 131 of the spacing portions 13.

Then, another fastening member 1 is disposed on an upper horizontal edge 21 of a siding board 2, and is fixed to the framework 3. At this time, as shown in FIG. 7A, the fastening member 1 is disposed so that the lower-board engagement portion 122 of the fastening member 1 is engaged with the upper horizontal edge 21 of the siding board 2. Subsequently, the screw 4 is inserted into the screw hole 112 formed in the base plate portion 11 of the fastening member 1, and is screwed into the vertical column 31 of the framework 3.

At the final stage of screwing of the screw 4 into the framework 3, as shown in FIG. 7A, the head portion 41 engages with the sloped portion 113 formed in the base plate portion 11 of the fastening member 1. From this engaged state, the screw 4 is further screwed into the framework 3 in the horizontal direction shown by an arrow D. Thereby, a force downwardly thrusting the fastening member 1 works (arrow E). According to the force, as shown in FIG. 7B, the fastening member 1 is pushed down, thereby causing the support portion 12 and the lower-board engagement portion 122 to forcedly engage with the upper horizontal edge 21 of the lower siding board 2.

Subsequently, as in the case of the above-described lowest siding board 2, a lower horizontal edge 22 of a second-stage siding board 2 is disposed to be supported by the support portion 12 of the fastening member 1. Further, a fastening member 1 is disposed on an upper horizontal edge 21 and is fixed to the framework 3. In this way, the second stage siding board 2 is fixed.

Thereafter, the above-described steps are sequentially repeated to fabricate siding boards attachment structures 5.

Hereinafter, operational advantages of the above-described present embodiment will be described.

As described above, the fastening member 1 has the spacing portions 13. The construction is therefore performed by setting the rear side surfaces 26 of the siding boards 2 to abut on the spacing portions 13. This enables the ventilation space 51 to be formed behind the siding boards 2. That is, a sufficient gap is provided between the siding boards 2 and the framework 3, thereby enabling ventilation characteristics to be secured. This allows the siding board 2 and the framework 3 to be prevented from being corroded and deteriorated.

The fastening member 1 has the spacing portions 13 individually formed at the left and right sides. Therefore the rear side surfaces 26 of the siding boards 2 abut on the spacing portion, whereby the fastening member can support the siding boards 2 in a stable state. Consequently, the siding boards attachment structure 5 can be constructed to have high resistances for wind pressure and the like, and a high structural strength.

In addition, since the fastening member 1 has the base plate portion 11 including the flat rear side surface 111, the entirety of the rear side surface 111 of the base plate portion 11 can be set to abut on the framework 3. In this case, a contact area of the fastening member 1 and the framework 3 as an underlayment on which the fastening member abuts is large. Therefore, the fastening member 1 can be fixed to be stable.

Therefore, the siding boards attachment structure 5 can be constructed to have high resistances for wind pressure and a high structural strength.

Each of the spacing portions 13 is formed to have the front face forwardly formed 15 mm away from the rear side surface 111 of the base plate portion 11. Therefore, the siding board 2 can be fixed to be sufficiently away from the framework 3. Consequently, the ventilation space 51 having a sufficient thickness can be formed behind the siding boards 2.

Specifically, the ventilation space 51 has a thickness of 15 mm. This improves the ventilation characteristics of the siding boards attachment structure 5, thereby securely enabling the siding boards 2, the framework 3, and the like to be prevented from being corroded and deteriorated.

The lower reinforcement portion 141 is formed between the support portion 12 and a lower portion of the base plate portion 11, which is below the support portion 12. The lower reinforcement portion 141 improves the structural strength of the support portion 12, thereby enabling it to support a heavier siding board 2.

Furthermore, even with a fastening member 1 formed to have a support portion 12 forwardly extending even longer than the greatly projecting spacing portions 13, the load of the siding board 2 can be sufficiently supported.

Still furthermore, as described above, the present embodiment is constructed such that the base plate portion 11 has the sloped portion 113, in which, when the screw 4 inserted into the screw hole 112 is screwed into the framework 3, the head portion 41 of the screw 4 engages with the sloped portion 113, thereby exerting a force for downwardly thrusting the fastening member 1 (as shown in FIGS. 7A and 7B).

According to the above construction, the siding boards 2 are securely fixed to the framework 3 by the fastening member 1.

Still furthermore, the fastening member 1 is integrally formed by bending a metal plate. Therefore, the fastening member 1 that can be easily manufactured and that is cheap can be obtained.

As described above, the present embodiment enables the provision of the siding boards attachment structure that is excellent in ventilation characteristics and that has a high fixing strength, and the fastening member 1 to be used therewith.

Embodiment 2

As shown in FIGS. 8, 9A, 9B, and 9C, Embodiment 2 exemplifies the present invention is made by modifying the shape of the above-described fastening member 1.

Figure 8:
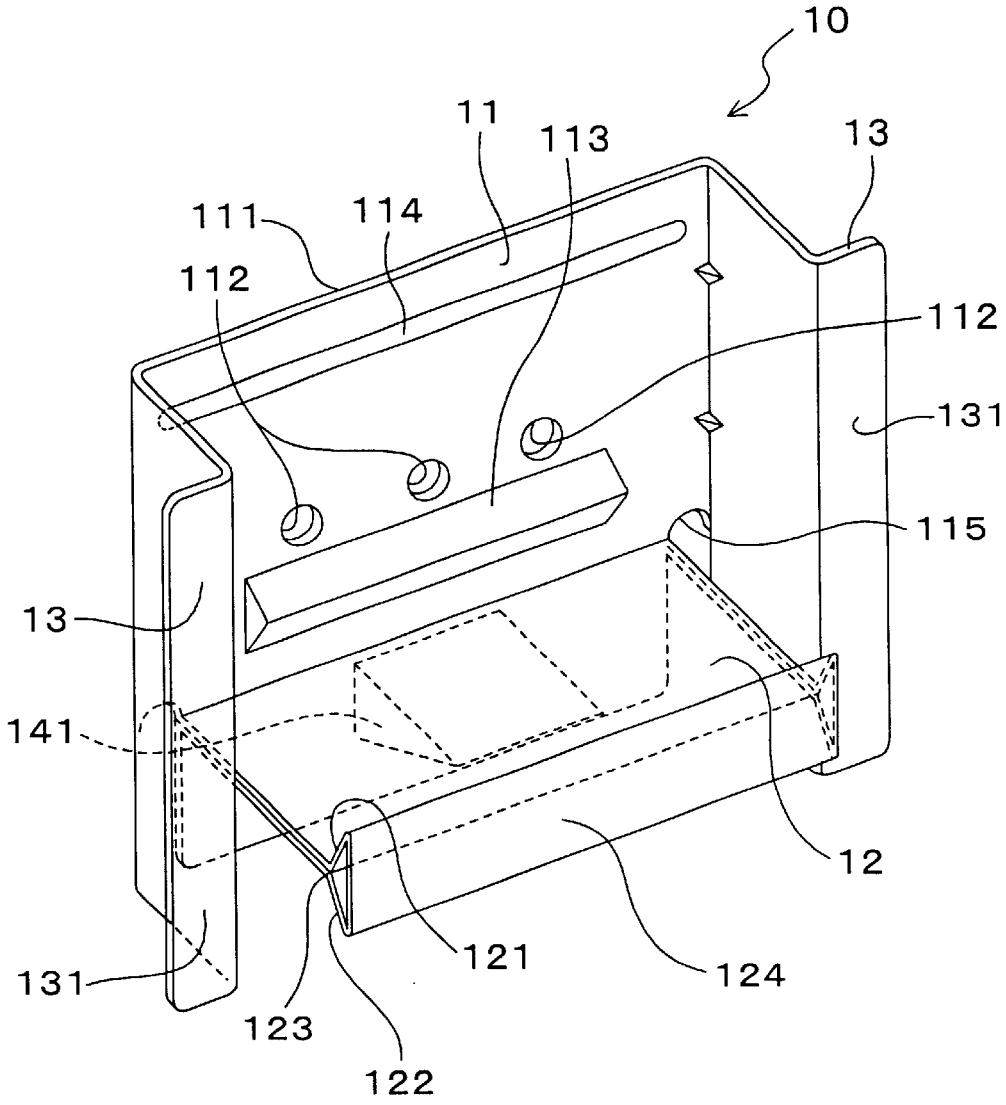
FIG. 8 is a perspective view of a fastening member according to Embodiment 2.
Figure 9A:
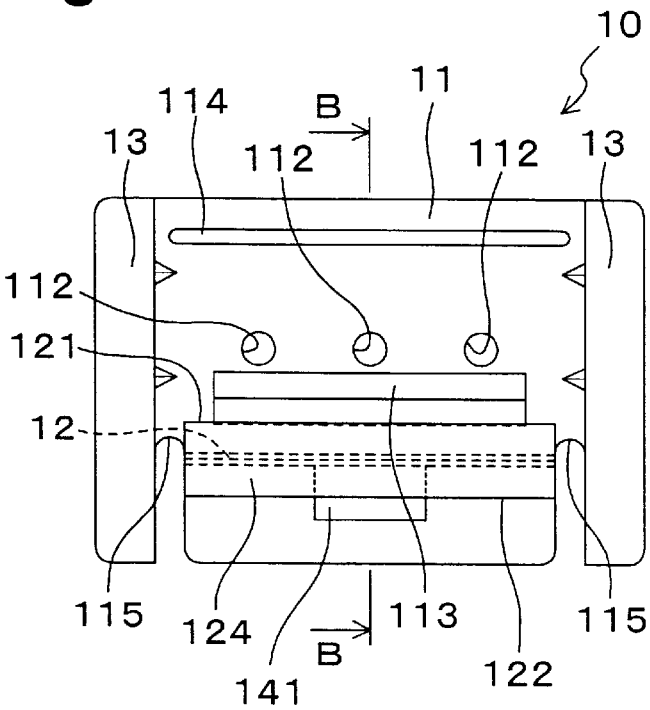
FIG. 9A is a front view of the fastening member according to the Embodiment 2.
Figure 9B:
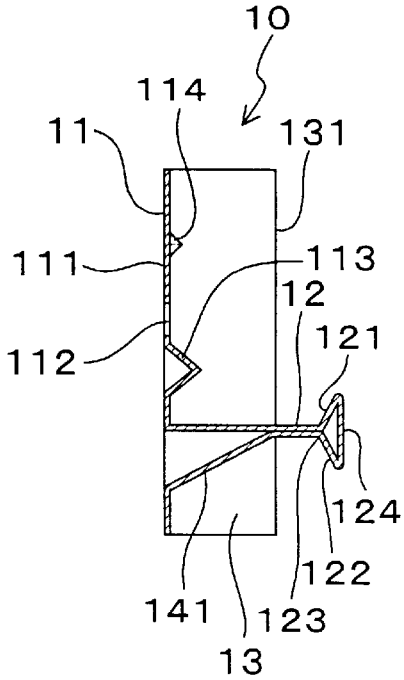
FIG. 9B is a cross sectional view taken along the line B—B of FIG. 9A.
Figure 9C:
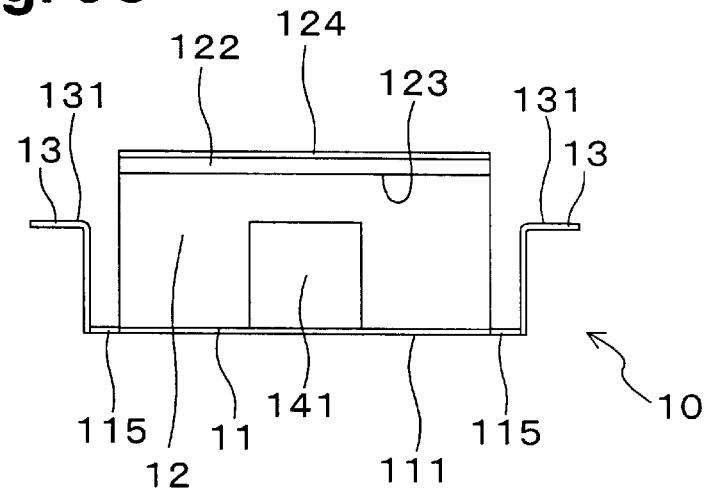
FIG. 9C is a bottom view thereof.

Specifically, as shown in FIG. 9C, a fastening member 10 has spacing portions 13 each formed to have an L-shaped cross section. As shown in FIGS. 8, 9A, and 9B, three screw holes 112 are formed in the base plate portion 11, and a sloped portion 113 continually formed in the horizontal direction below the screw holes 112.

In addition, the base plate portion 11 has a rib 114 forwardly protruding by about 1 mm, which is horizontally formed in an upper portion thereof.

Other portions are similar to those of the Embodiment 1.

As operational advantages, similarly to the Embodiment 1, the Embodiment 2 also enables the provision of the siding boards attachment structure that is excellent in ventilation characteristics and that has a high fixing strength, and the fastening member 10 used therewith.

Other operational advantages are similar to those of the Embodiment 1.

Embodiment 3

Figure 10:
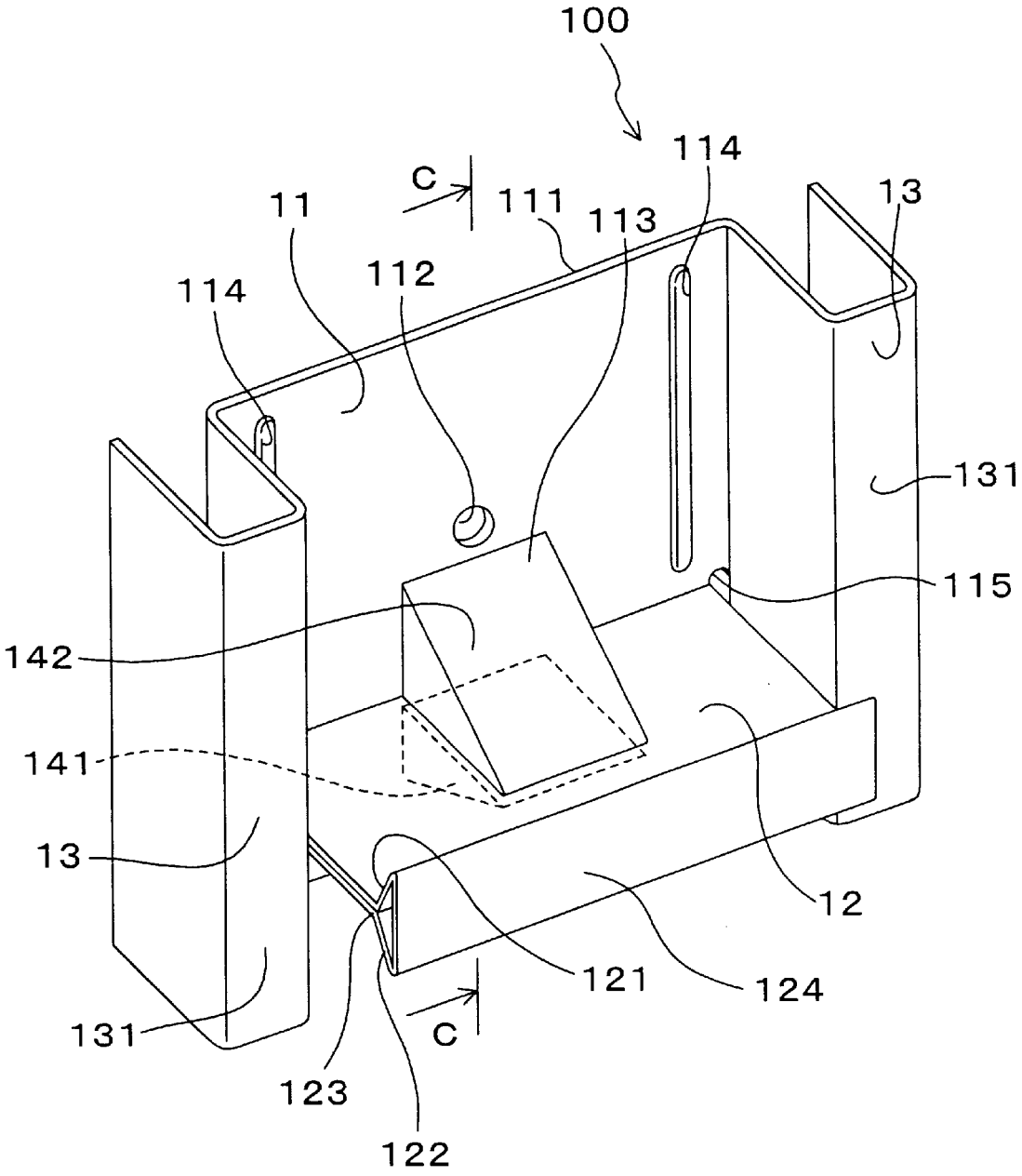
FIG. 10 is a perspective view of a fastening member according to Embodiment 3.
Figure 11:
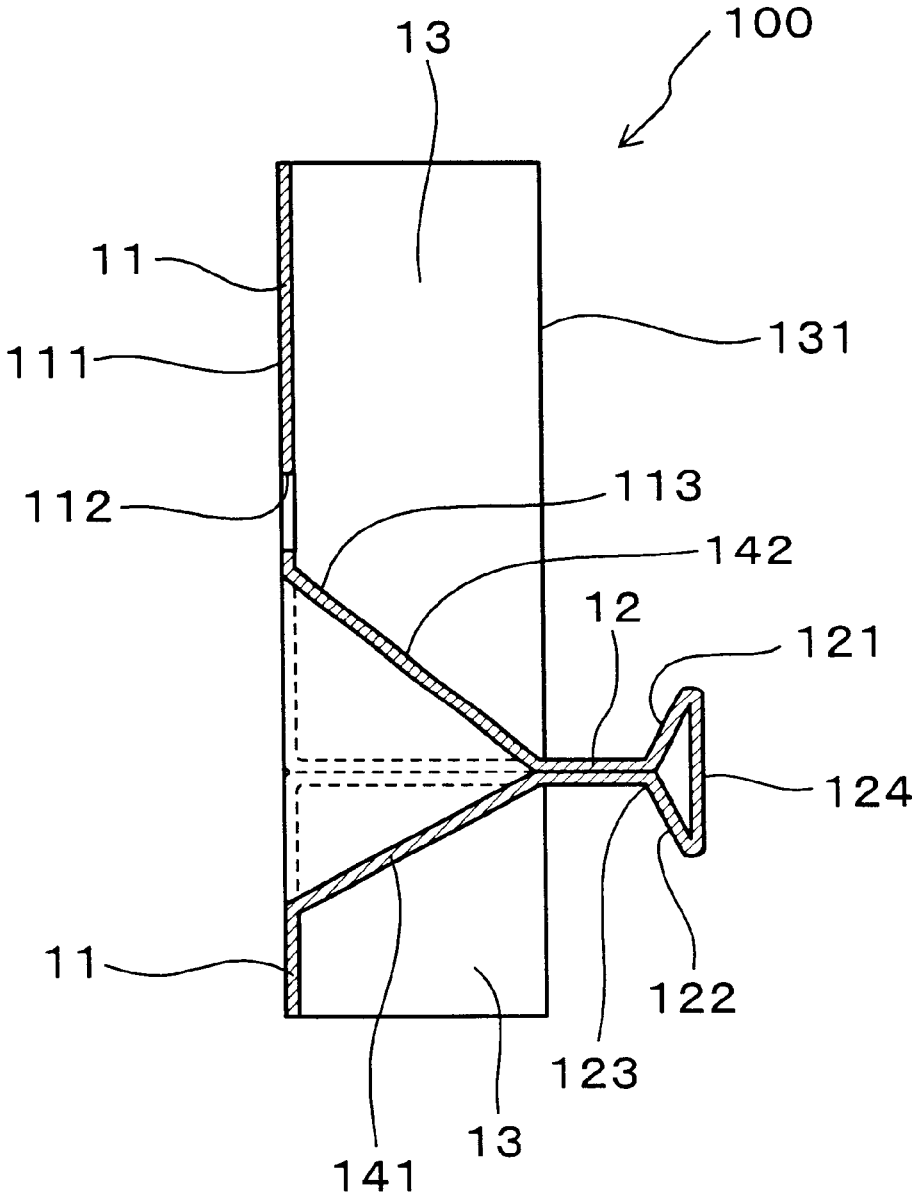
FIG. 11 is a cross sectional view along the line C—C of FIG. 10.

As shown in FIGS. 10 and 11, Embodiment 3 exemplifies the present invention with a fastening member 100. In the fastening member 100, an upper reinforcement portion 142 is formed between a support portion 12 and an upper portion of a base plate portion 11, which is above the support portion 12. The upper reinforcement portion 142 downwardly reinforces the support portion 12 from an upper portion.

The upper reinforcement portion 142 is integrated with a sloped portion 113 formed forward and downward from a lower portion of screw holes 112 of a base plate portion 11. That is, the present embodiment is structured such that an upper end portion of the upper reinforcement portion 142 serves as the sloped portion 113, and the head portion 41 of the screw 4 engages with the sloped portion 113.

Other portions are similar to those of the Embodiment 1.

According to the above, the fastening member 100 having the support portion 12 that has an even higher strength for the load of the siding board 2 can be obtained.

Other operational advantages are similar to those of the Embodiment 1.

Embodiment 4

Figure 12:
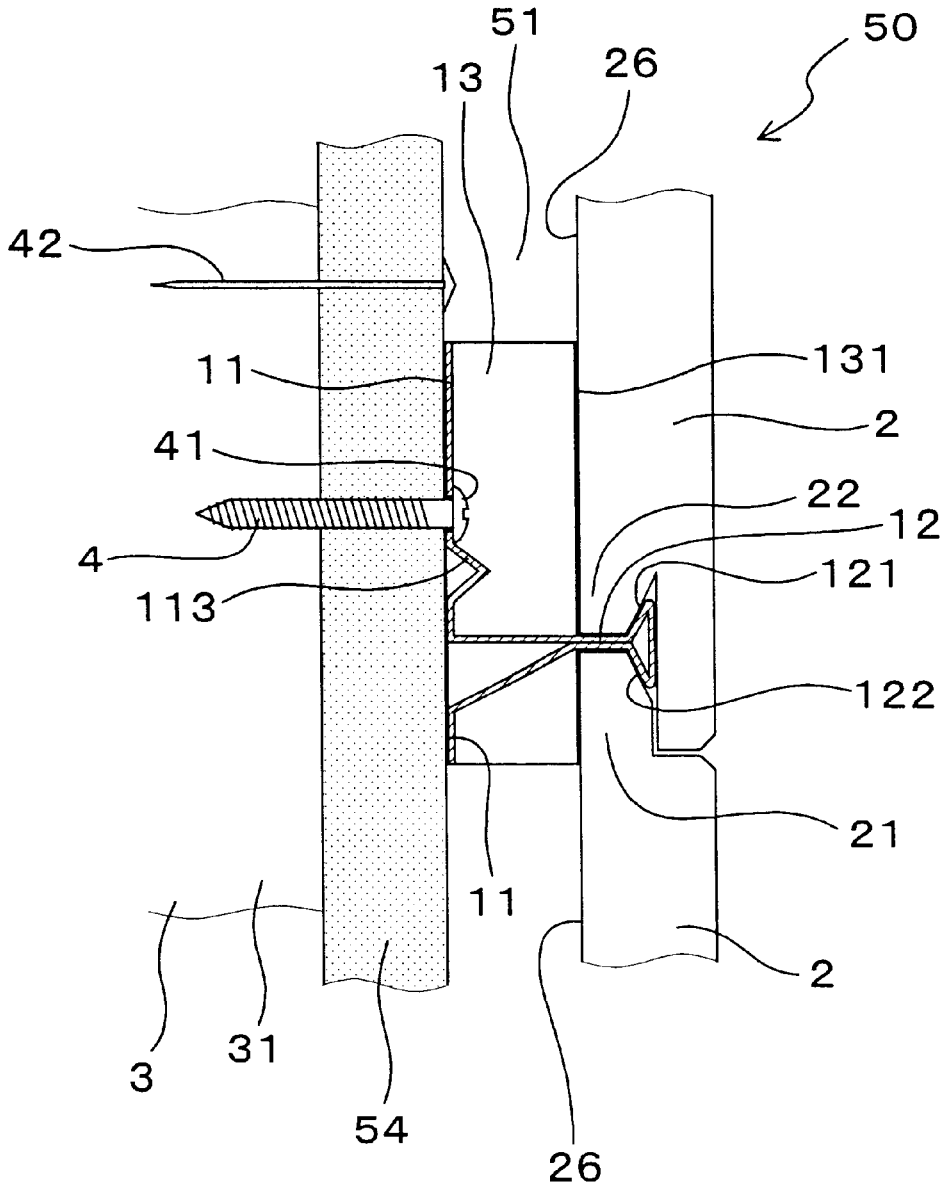
FIG. 12 is a vertical cross sectional view of a siding boards attachment structure according to Embodiment 4 of the present invention.
Figure 13:
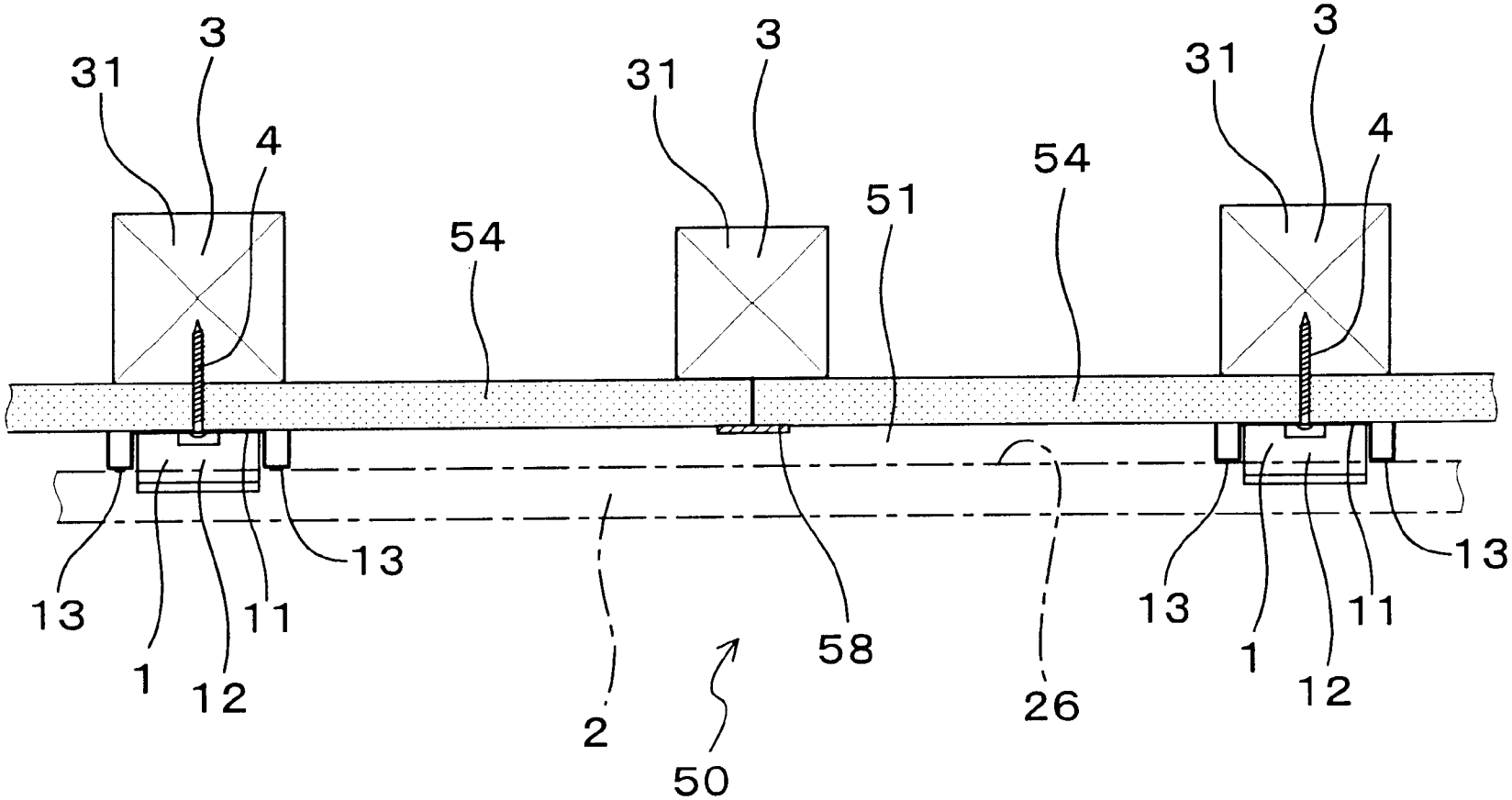
FIG. 13 is a horizontal cross sectional view of the siding boards attachment structure according to the Embodiment 4.
Figure 14:
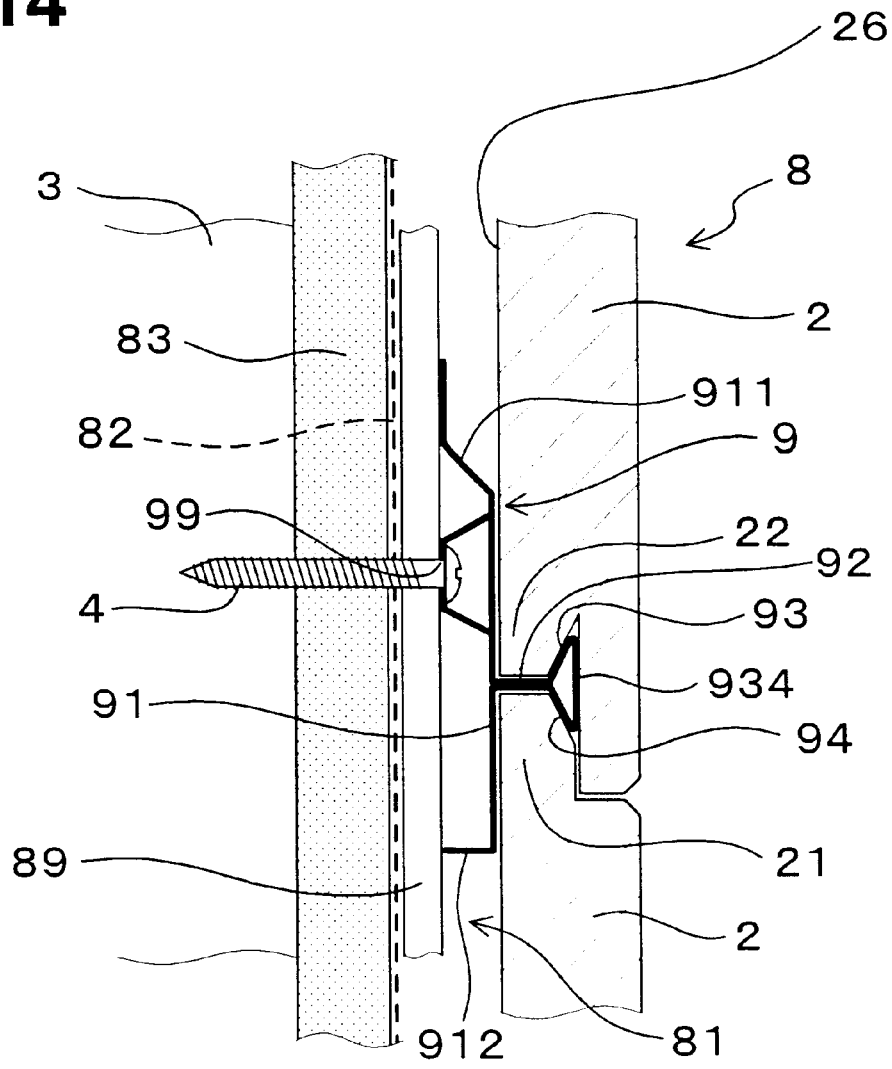
Fig. 14 Prior Art
FIG. 14 is a vertical cross sectional view of a conventional example of a siding boards attachment structure using a furring strip.
Figure 15:
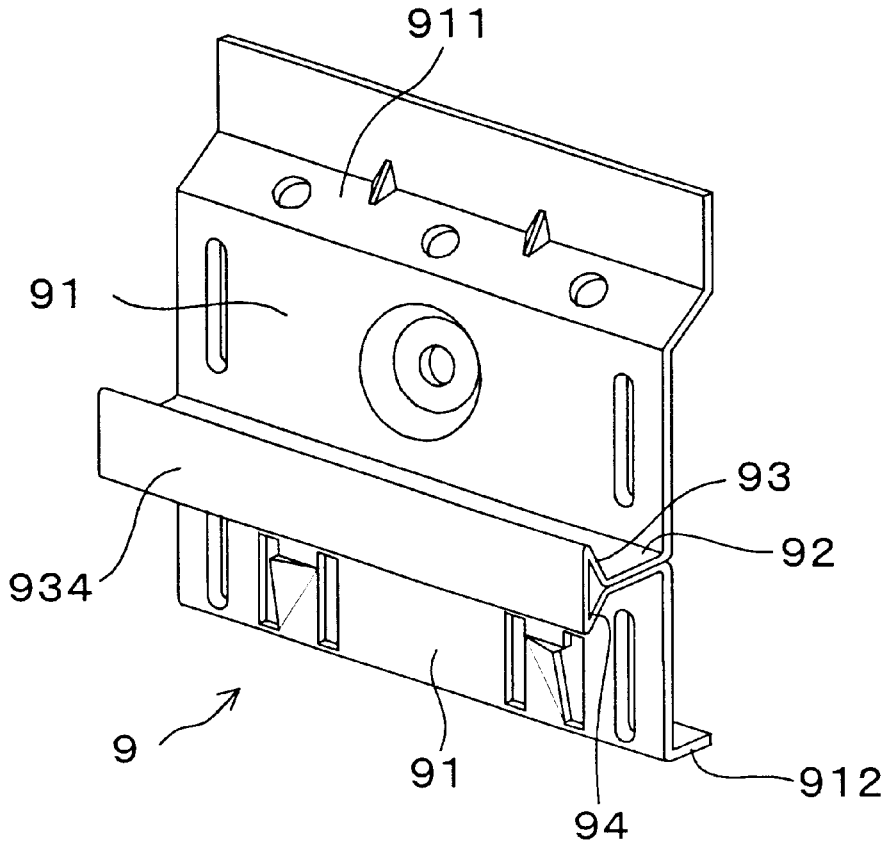
Prior Art Fig. 15
FIG. 15 is a perspective view of a conventional example of a fastening member.
Figure 16B:
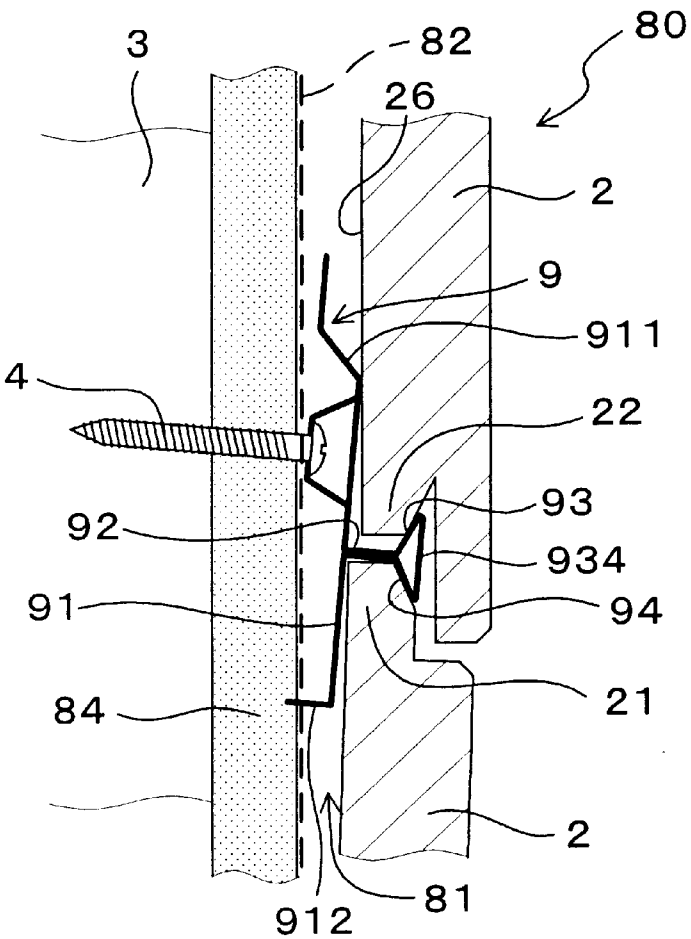
FIG. 16B is a view used to explain a defect caused therein.
Figure 16A:
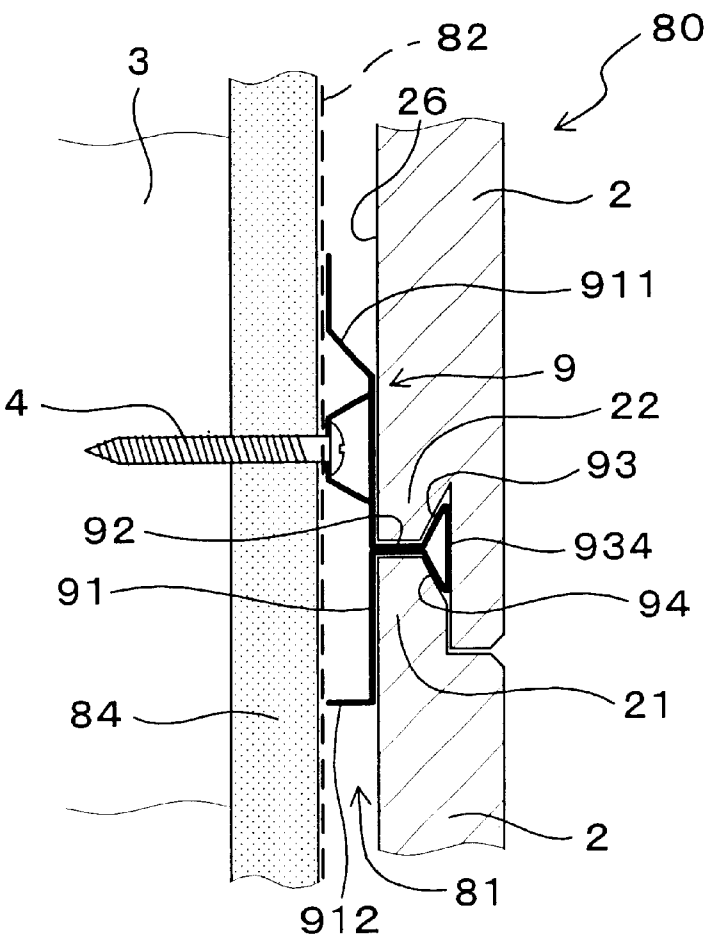
FIG. 16A is a vertical cross sectional view of the siding boards attachment structure wherein the fastening member is abutted on a heat insulator.

As shown in FIGS. 12 and 13, Embodiment 4 exemplifies the present invention with a siding boards attachment structure 50 in which a heat insulator 54 is fixed to the outside of a framework 3.

As shown in FIGS. 12 and 13, in the siding boards attachment structure 50, a base plate portion 11 is set to abut on the heat insulator 54, spacing portions 13 are set to abut on the rear side surfaces 26 of the siding boards 2, and fastening member 1 is thereby fixed to the framework 3.

In addition, a ventilation space 51 is formed between the heat insulator 54 and the siding boards 2.

For the heat insulator 54, a sheathing board is used. The heat insulator 54 is fixed with an umbrella-shaped nail to a vertical column 31 or a horizontal column in the framework 3.

Since the heat insulator 54 also has waterproof characteristics, no waterproof paper is used. As shown in FIG. 13, a plurality of the heat insulators 54 are aligned, in which waterproof tapes 58 are adhered to joints therebetween, thereby securing waterproof characteristics.

Other portions are similar to those of the Embodiment 1.

In the siding boards attachment structure 50, the heat insulator 54 can be fixed from the outside of the framework 3. Therefore, the siding boards attachment structure 50 having heat-insulating effects can easily be constructed.

Furthermore, in the siding boards attachment structure 50, although the heat insulator 54 is soft, when the base plate portion 11 of the fastening member 1 is set to abut on the surface thereof, a rear side surface 111 of the base plate portion 11 is flat. The contact area where it contacts the heat insulator 54 is large. Therefore, the base plate portion 11 is not sunk into the heat insulator 54. Therefore, the fastening member 1 can be fixed to the framework 3 via the heat insulator 54 to be stable.

Other operational advantages are similar to those of the Embodiment 1.

For the heat insulator in the above-described Embodiment 4, a material such as a stylofoam, an oriented strand board (OSB) or the like may be used.

Furthermore, the above-described siding boards attachment structure may be constructed according to an external insulation method. In this case, for example, a styrene board, is used as the heat insulator.

Also in this case, operational advantages similar to those of the Embodiment 4 can be provided.

Obviously, numerous modifications and variations of the present invention are possible in light of the above teachings. It is therefore to be understood that, within the scope of the appended claims, the invention may be practiced otherwise than as specifically described here.

What is claimed is:

1. A fastening member, comprising:

a base plate portion having a flat rear side surface for directly securing the fastening member to a framework of a building;

a support portion projecting forward from the base plate portion;

an upper-board engagement portion bent upward from the support portion for engaging a lower horizontal edge of an upper siding board;

a lower-board engagement portion bent downward from the support portion for engaging an upper horizontal edge of a lower siding board; and spacing portions individually formed at left and right sides of the base plate portion, each of the spacing portions comprising a front face which is forward from the base plate portion and rearward from the front end of the support portion;

wherein the base plate portion comprises a through-hole through which a fixing mechanism for fixing the fastening member to the framework is inserted; and wherein the base plate is substantially solid except for said through-hole.

2. A fastening member as claimed in claim 1, wherein each of the spacing portions has a front face forwardly formed 15 to 20 mm away from the rear side surface of the base plate portion.

3. A fastening member as claimed in claim 1, comprising a lower reinforcement portion between the support portion and a lower portion of the base plate portion, which is below the support portion, for reinforcing the support portion from a lower portion.

4. A fastening member as claimed in claim 1, comprising an upper reinforcement portion between the support portion and an upper portion of the base plate portion, which is above the support portion, for reinforcing the support portion from an upper portion.

5. A fastening member as claimed in claim 1, wherein the through-hole is a screw-hole and the fixing mechanism is a screw;

a sloped portion protruding forward and downward from the base plate portion is formed in a position below the screw hole; and when the screw inserted through the screw hole is screwed into the framework, a head portion of the screw engages with the sloped portion, thereby exerting a force downwardly thrusting the fastening member.

6. A fastening member as claimed in claim 5, wherein the sloped portion is integrated with the upper reinforcement portion.

7. A fastening member as claimed in claim 1, wherein the fastening member is integrally formed by bending a metal plate.

8. A starter fastening member, comprising:

a base plate portion having a flat rear side surface for directly securing the fastening member to a framework of a building;

a support portion projecting forward from the base plate portion for engaging a lower horizontal edge of a lowest siding board;

an upper-board engagement portion bent upward from the support portion; and spacing portions individually formed at left and right sides of the base plate portion, each of the spacing portions comprising a front face which is forward from the base plate portion and rearward from the front end of the support portion;

wherein the base plate portion comprises a through-hole through which a fixing mechanism for fixing the fastening member to the framework is inserted; and wherein the base plate is substantially solid except for said through-hole.

9. A starter fastening member as claimed in claim 8, wherein each of the spacing portions has a front face forwardly formed 15 to 20 mm away from the rear side surface of the base plate portion.

10. A starter fastening member as claimed in claim 8, comprising a lower reinforcement portion between the support portion and a lower portion of the base plate portion, which is below the support portion, for reinforcing the support portion from a lower portion.

11. A starter fastening member as claimed in claim 8, comprising an upper reinforcement portion between the support portion and an upper portion of the base plate portion, which is above the support portion, for reinforcing the support portion from an upper portion.

12. A starter fastening member as claimed in claim 8, wherein the through-hole is a screw hole and the fixing mechanism is a screw;

a sloped portion protruding forward and downward from the base plate portion is formed in a position below the screw hole; and when the screw inserted through the screw hole is screwed into the framework, a head portion of the screw engages with the sloped portion, thereby exerting a force downwardly thrusting the fastening member.

13. A starter fastening member as claimed in claim 12, wherein the sloped portion is integrated with the upper reinforcement portion.

14. A starter fastening member as claimed in claim 8, wherein the fastening member is integrally formed by bending a metal plate.

15. A siding boards attachment structure comprising:

a fastening member disposed on an upper horizontal edge and a lower horizontal edge of siding boards, wherein the fastening member includes:

a base plate portion having a flat rear side surface for directly securing the fastening member to a framework of a building;

a support portion projecting forwardly from the base plate portion;

an upper-board engagement portion bent upwardly from the support portion for engaging a lower horizontal edge of an upper siding board;

a lower-board engagement portion bent downwardly from the support portion for engaging an upper horizontal edge of a lower siding board; and spacing portions individually formed at left and right sides of the base plate portion, each of the spacing portions having a front face which is located forwardly of the base plate portion and rearwardly of the front end of the support portion, wherein the base plate portion includes a through-hole through which a fixing mechanism, for fixing the fastening member to the framework of the building, is inserted, and wherein the base plate portion is substantially solid except for the through-hole;

siding boards fixed to the framework of the building, wherein the fastening member is fixed to the framework such that the base plate portion is set to abut on the framework, and the spacing portions are set to abut on rear side surfaces of the siding boards; and a ventilation space is formed between the framework and the siding boards.

16. The siding boards attachment structure as claimed in claim 15, wherein the ventilation space has a thickness ranging from 15 to 20 mm.

17. A siding boards attachment structure comprising:

a starter fastening member disposed on a lower horizontal edge of a lowest siding board, wherein the starter fastening member includes:

a base plate portion having a flat rear side surface for directly securing the starter fastening member to a framework of a building;

a support portion projecting forwardly from the base plate portion for engaging a lower horizontal edge of the lowest siding board;

an upper-board engagement portion bent upwardly from the support portion; and spacing portions individually formed at left and right sides of the base plate portion, each of the spacing portions having a front face which is located forwardly of the base plate portion and rearwardly of a front end of the support portion, wherein the base plate portion includes a through-hole through which a fixing mechanism, for fixing the starter fastening member to the framework of the building, is inserted, and wherein the base plate portion is substantially solid except for the through-hole;

a siding board fixed to the framework of the building, wherein the starter fastening member is fixed to the framework such that the base plate portion is set to abut on the framework, and the spacing portions are set to abut on a rear side surface of the siding board; and a ventilation space is formed between the framework and the siding board.

18. The siding boards attachment structure as claimed in claim 17, wherein the ventilation space has a thickness ranging from 15 to 20 mm.

19. A siding boards attachment structure comprising:

a fastening member disposed on an upper horizontal edge and a lower horizontal edge of siding boards, wherein the fastening member includes:

a base plate portion having a flat rear side surface for directly securing the fastening member to a framework of a building;

a support portion projecting forwardly from the base plate portion;

an upper-board engagement portion bent upwardly from the support portion for engaging a lower horizontal edge of an upper siding board;

a lower-board engagement portion bent downwardly from the support portion for engaging an upper horizontal edge of a lower siding board; and spacing portions individually formed at left and right sides of the base plate portion, each of the spacing portions having a front face which is located forwardly of the base plate portion and rearwardly of the front end of the support portion, wherein the base plate portion includes a through-hole through which a fixing mechanism, for fixing the fastening member to the framework of the building, is inserted, and wherein the base plate portion is substantially solid except for said through-hole; and siding boards fixed to the framework of the building, wherein:

a heat insulator is fixed to an outside of the framework;

the fastening member is fixed to the framework such that the base plate portion is set to abut on the heat insulator, and the spacing portions are set to abut on rear side surfaces of the siding boards; and a ventilation space is formed between the heat insulator and the siding boards.

20. The siding boards attachment structure as claimed in claim 19, wherein the ventilation space has a thickness ranging from 15 to 20 mm.

21. A siding boards attachment structure comprising:

a starter fastening member disposed on a lower horizontal edge of a lowest siding board, wherein the starter fastening member includes:

a base plate portion having a flat rear side surface for directly securing the starter fastening member to a framework of a building;

a support portion projecting forwardly from the base plate portion for engaging a lower horizontal edge of the lowest siding board;

an upper-board engagement portion bent upwardly from the support portion; and spacing portions individually formed at left and right sides of the base plate portion, each of the spacing portions having a front face which is located forwardly of the base plate portion and rearwardly of a front end of the support portion, wherein the base plate portion includes a through-hole through which a fixing mechanism, for fixing the starter fastening member to the framework of the building, is inserted, and wherein the base plate portion is substantially solid except for the through-hole; a siding board fixed to the framework of the building, wherein:

a heat insulator is fixed to an outside of the framework;

the starter fastening member is fixed to the framework such that the base plate portion is set to abut on the heat insulator, and the spacing portions are set to abut on a rear side surface of the siding board; and a ventilation space is formed between the heat insulator and the siding board.

22. The siding boards attachment structure as claimed in claim 17, wherein the ventilation space has a thickness ranging from 15 to 20 mm.

* * * * *

UNITED STATES PATENT AND TRADEMARK OFFICE

CERTIFICATE OF CORRECTION

PATENT NO. : 6,598,362 B2
DATED : July 29, 2003
INVENTOR(S) : Hikai

It is certified that error appears in the above-identified patent and that said Letters Patent is hereby corrected as shown below:

Title page, Item [54] and Column 1, line 1,
Title, should read:
-- [54] FASTENING MEMBER AND SIDING BOARDS ATTACHMENT STRUCTURE --

Signed and Sealed this

Fourth Day of November, 2003

JAMES E. ROGAN
*Director of the United States Patent and Trademark Office*